US009878336B2

(12) United States Patent
Gehrung

(10) Patent No.: US 9,878,336 B2
(45) Date of Patent: Jan. 30, 2018

(54) FLUID RESERVOIR FOR A PAINT SPRAY GUN

(75) Inventor: Ralf Gehrung, Stuttgart (DE)

(73) Assignee: SATA GMBH & CO. KG, Kornwestheim (DE)

( * ) Notice: Subject to any disclaimer, the term of this patent is extended or adjusted under 35 U.S.C. 154(b) by 959 days.

(21) Appl. No.: 11/949,122

(22) Filed: Dec. 3, 2007

(65) Prior Publication Data

US 2008/0128533 A1 Jun. 5, 2008

(30) Foreign Application Priority Data

Dec. 5, 2006 (DE) ..... 10 2006 057 621

(51) Int. Cl.

| | |
|---|---|
| ***B65D 47/08*** | (2006.01) |
| ***B05B 7/24*** | (2006.01) |
| ***B65D 51/16*** | (2006.01) |
| ***B65D 43/14*** | (2006.01) |
| ***B05B 7/30*** | (2006.01) |

(52) U.S. Cl.

CPC ..... *B05B 7/2408* (2013.01); *B05B 7/2478* (2013.01)

(58) Field of Classification Search

CPC . B05B 7/2408; B05B 7/2478; B65D 47/0861; B65D 47/0871; B65D 2251/1058

USPC ..... 220/203.07, 367.1, 203.13, 835; 239/348, 345

See application file for complete search history.

(56) References Cited

U.S. PATENT DOCUMENTS

| | | | |
|---|---|---|---|
| 40,433 | A | 10/1863 | Sees |
| 327,260 | A | 9/1885 | Hart |

(Continued)

FOREIGN PATENT DOCUMENTS

| | | |
|---|---|---|
| AT | 153883 | 6/1997 |
| AT | 163577 | 3/1998 |

(Continued)

OTHER PUBLICATIONS

Printout from Internet www.ehow.com explaining how to choose a spray gun and stating in item 2 "Nozzle sizes vary between about 1 mm and 2 mm.", printed Sep. 7, 2012 (EXHIBIT 1023 in IPR 2013-0111).

Printout from Internet www.bodyshopbusiness.com explaining how to choose nozzle setup in paragraph bridging pp. 1 and 2, giving general rule of thumb of nozzle sizes from 1.3 mm to 2.2 mm, depending on material being sprayed, printed Sep. 7, 2012 (EXHIBIT 1024 in IPR 2013-0111).

Printout from Internet of pages from brochure of Walther Pilot showing nozzle sizes for spray guns ranging from 0.3 mm to 2.5 mm, dated 2007, (EXHIBIT 1025 in IPR 2013-0111).

(Continued)

*Primary Examiner* — Andrew T Kirsch

(74) *Attorney, Agent, or Firm* — Paul D. Bianco; Gary S. Winer; Fleit Gibbons Gutman Bongini & Bianco PL

(57) ABSTRACT

The invention relates to a fluid reservoir for a paint spray gun with a container (1) and a cover (2) that is attachable on this container and has a connection part (3) to enable attaching the fluid reservoir on the paint spray gun or on an adapter, wherein the container (1) has a ventilation opening (6) that can be closed by a valve (5). In a fluid reservoir known from the state of the art, the valve is constructed in the form of a sliding valve. Here, there is the risk that the ventilation opening is not completely closed if the slide of the sliding valve has not been pushed completely into the valve housing. In order to provide a fluid reservoir with a valve that can be easily actuated manually and that can be closed reliably, it is provided for the fluid reservoir according to the invention that the valve (5) has a closing element (8) that can pivot like a rocker about a pivot axis (7) for closing the ventilation opening (6) in a fluid-tight way.

16 Claims, 3 Drawing Sheets

(56) References Cited

U.S. PATENT DOCUMENTS 459,432 A 9/1891 Anderson
459,433 A 9/1891 Avery
548,816 A 10/1895 Paul
552,213 A 12/1895 Troy
552,715 A 1/1896 Lugrin
563,505 A 7/1896 McCornack
581,107 A 4/1897 Emery
644,803 A 3/1900 Justi
672,012 A 4/1901 Ruper
574,880 A 5/1901 Schmidt et al.
1,662,496 A 3/1928 Forsgard
1,703,383 A 2/1929 Birkenmaier
1,703,384 A 2/1929 Birkenmaier
1,711,221 A 4/1929 Blakeslee
1,751,787 A 3/1930 Binks
1,889,201 A 11/1932 Holveck
2,008,381 A 7/1935 Beeg
2,049,700 A 8/1936 Gustafsson
2,051,210 A 8/1936 Gustafsson
2,070,696 A 2/1937 Tracy
2,116,036 A 5/1938 Money
2,125,445 A 8/1938 Holveck
2,198,441 A 4/1940 Lobegott
2,204,599 A 6/1940 Jenkins
2,269,057 A 1/1942 Jenkins
D133,223 S 7/1942 Tammen
2,356,865 A 8/1944 Mason
2,416,856 A 3/1947 Thomsen
2,416,923 A 3/1947 Jenkins
2,557,593 A 6/1951 Bjorkman
2,557,606 A 6/1951 Liedberg
2,559,091 A 7/1951 Reasenberg
2,609,961 A 9/1952 Sapien
2,612,899 A 10/1952 Webb
2,646,314 A 7/1953 Peeps
2,721,004 A 10/1955 Schultz
2,844,267 A 7/1958 Petriccione
2,886,252 A 5/1959 Ehrensperger
3,090,530 A 5/1963 Peeps
D196,477 S 10/1963 Kelly
3,159,472 A 12/1964 Revell
D200,594 S 3/1965 Sass
3,240,398 A 3/1966 Dalton, Jr.
D204,306 S 4/1966 Hamm
D205,760 S 9/1966 Hocutt et al.
3,297,192 A * 1/1967 Swett ..... 220/840
D208,903 S 10/1967 Zadron et al.
3,344,992 A 10/1967 Norris
3,381,845 A 5/1968 MacDonald
3,417,650 A 12/1968 Varrin
3,420,106 A 1/1969 Keller et al.
3,435,683 A 4/1969 Keller et al.
3,482,781 A 12/1969 Sharpe
D217,928 S 6/1970 Felske
3,524,589 A 8/1970 Pelton, Jr.
3,527,372 A 9/1970 Manning
3,583,632 A 6/1971 Schaffer
3,622,078 A 11/1971 Gronert
3,645,562 A 2/1972 Fandetti et al.
3,656,493 A 4/1972 Black et al.
3,714,967 A 2/1973 Zupan et al.
3,746,253 A 7/1973 Walberg
3,747,850 A 7/1973 Hastings et al.
3,771,539 A 11/1973 De Santis
3,840,143 A 10/1974 Davis et al.
3,848,807 A 11/1974 Partida
3,857,511 A 12/1974 Govindan
3,870,223 A 3/1975 Wyant
3,873,023 A 3/1975 Moss et al.
4,000,915 A 1/1977 Strom
D245,048 S 7/1977 Pool
D252,097 S 6/1979 Probst et al.
4,160,525 A 7/1979 Wagner
4,210,263 A 7/1980 Bos
4,273,293 A 6/1981 Hastings
4,411,387 A * 10/1983 Stern et al. ..... 239/345
4,478,370 A 10/1984 Hastings
D276,472 S 11/1984 Harrison
D278,543 S 4/1985 Gintz
4,545,536 A 10/1985 Avidon
4,562,965 A 1/1986 Ihmels et al.
4,580,035 A 4/1986 Luscher
4,585,168 A 4/1986 Even et al.
4,614,300 A 9/1986 Falcoff
4,643,330 A 2/1987 Kennedy
4,653,661 A * 3/1987 Buchner et al. ..... 220/203.16
4,667,878 A 5/1987 Behr
4,713,257 A 12/1987 Luttermoeller
D293,950 S 1/1988 Ogden et al.
4,730,753 A 3/1988 Grime
4,767,057 A 8/1988 Degli et al.
D298,372 S 11/1988 Taylor, Jr.
4,784,184 A 11/1988 Gates
4,806,736 A 2/1989 Schirico
4,826,539 A 5/1989 Harpold
4,832,232 A 5/1989 Broccoli
4,863,781 A 9/1989 Kronzer
4,877,144 A 10/1989 Thanisch
D305,057 S 12/1989 Morgan
4,887,747 A * 12/1989 Ostrowsky et al. ..... 222/556
4,901,761 A 2/1990 Taylor
4,906,151 A 3/1990 Kubis
4,917,300 A 4/1990 Gloviak et al.
4,946,075 A 8/1990 Lundback
4,964,361 A 10/1990 Aebersold
4,967,600 A 11/1990 Keller
4,969,603 A 11/1990 Norman
4,973,184 A 11/1990 La Salle
D314,421 S 2/1991 Tajima et al.
D314,588 S 2/1991 Denham
4,989,787 A 2/1991 Nikkei
5,020,700 A 6/1991 Krzywdziak et al.
D318,877 S 8/1991 Miranda et al.
5,042,840 A 8/1991 Rieple et al.
D321,597 S 11/1991 Cerny
5,064,119 A 11/1991 Mellette
5,071,074 A 12/1991 Lind
5,074,334 A 12/1991 Onodera
5,078,323 A 1/1992 Frank
5,080,285 A 1/1992 Toth
5,088,648 A 2/1992 Schmon
5,090,623 A 2/1992 Burns et al.
5,102,045 A 4/1992 Diana
5,119,992 A 6/1992 Grime
5,125,391 A 6/1992 Srivastava et al.
5,135,124 A 8/1992 Wobser
5,143,102 A 9/1992 Blaul
5,165,605 A 11/1992 Morita et al.
5,170,941 A 12/1992 Morita et al.
5,190,219 A 3/1993 Copp, Jr.
5,191,797 A 3/1993 Smith
5,228,488 A 7/1993 Fletcher
5,232,299 A 8/1993 Hiss
5,236,128 A 8/1993 Morita et al.
5,249,746 A 10/1993 Kaneko et al.
D341,186 S 11/1993 Albers
5,289,974 A 3/1994 Grime et al.
5,322,221 A 6/1994 Anderson
5,325,473 A 6/1994 Monroe et al.
5,332,156 A 7/1994 Wheeler
5,333,506 A 8/1994 Smith et al.
5,333,908 A 8/1994 Dorney et al.
5,344,078 A 9/1994 Fritz et al.
5,346,099 A * 9/1994 Salmon ..... B65D 47/0861 220/832
5,367,148 A 11/1994 Storch et al.
D353,836 S 12/1994 Carvelli et al.
5,381,962 A 1/1995 Teague
5,435,491 A 7/1995 Sakuma
5,443,642 A 8/1995 Bienduga
5,456,414 A 10/1995 Burns et al.
D365,952 S 1/1996 Gagnon et al.
5,503,439 A 4/1996 LaJeunesse et al.
5,533,674 A 7/1996 Feyrer et al.

(56) References Cited

U.S. PATENT DOCUMENTS 5,540,385 A 7/1996 Garlick
5,540,386 A 7/1996 Roman
D376,637 S 12/1996 Kieffer
5,582,350 A 12/1996 Kosmyna et al.
5,584,899 A 12/1996 Shorts
5,588,562 A 12/1996 Sander et al.
5,592,597 A 1/1997 Kiss
5,609,302 A 3/1997 Smith
5,613,637 A 3/1997 Schmon
D380,301 S 7/1997 Kogutt
5,655,714 A 8/1997 Kieffer et al.
5,662,444 A 9/1997 Schmidt, Jr.
5,695,125 A 12/1997 Kumar
5,704,381 A 1/1998 Millan et al.
5,718,767 A 2/1998 Crum et al.
D391,403 S 3/1998 Josephs
RE35,769 E 4/1998 Grime et al.
5,762,228 A * 6/1998 Morgan et al. ..... 220/367.1
5,803,360 A 9/1998 Spitznagel
5,816,501 A 10/1998 LoPresti
5,836,517 A 11/1998 Burns et al.
D402,820 S 12/1998 Morison et al.
5,843,515 A 12/1998 Crum et al.
5,853,014 A 12/1998 Rosenauer
D405,503 S 2/1999 Edo
5,874,680 A 2/1999 Moore
5,884,006 A 3/1999 Frohlich et al.
D409,719 S 5/1999 Kaneko
5,941,461 A 8/1999 Akin et al.
5,951,190 A 9/1999 Wilson
5,951,296 A 9/1999 Klein
5,954,268 A 9/1999 Joshi et al.
D414,636 S 10/1999 Wiese
5,979,797 A 11/1999 Castellano
5,992,763 A 11/1999 Smith et al.
6,006,930 A 12/1999 Dreyer et al.
6,010,082 A 1/2000 Peterson
6,017,394 A 1/2000 Crum et al.
6,019,294 A 2/2000 Anderson
6,036,109 A 3/2000 DeYoung
6,039,218 A 3/2000 Beck
6,053,429 A 4/2000 Chang
6,056,213 A 5/2000 Ruta et al.
6,089,471 A 7/2000 Scholl
6,089,607 A 7/2000 Keeney et al.
6,091,053 A 7/2000 Aonuma
6,092,740 A 7/2000 Liu
6,132,511 A 10/2000 Crum et al.
D435,379 S 12/2000 Nguyen
6,250,567 B1 6/2001 Lewis et al.
6,276,616 B1 8/2001 Jenkins
D448,451 S 9/2001 Turnbull et al.
6,308,991 B1 10/2001 Royer
D457,599 S 5/2002 Karwoski
D459,432 S 6/2002 Schmon
D459,433 S 6/2002 Schmon
6,402,058 B2 6/2002 Kaneko et al.
6,402,062 B1 6/2002 Bending et al.
6,431,466 B1 8/2002 Kitajima
6,435,426 B1 8/2002 Copp, Jr.
6,442,276 B1 8/2002 Doljack
6,450,422 B1 9/2002 Maggio
6,494,387 B1 12/2002 Kaneko
6,536,684 B1 3/2003 Wei
6,536,687 B1 * 3/2003 Navis et al. ..... 239/345
D472,730 S 4/2003 Sparkowski
6,540,114 B1 4/2003 Popovich et al.
6,543,632 B1 4/2003 McIntyre et al.
6,547,884 B1 4/2003 Crum et al.
6,553,712 B1 4/2003 Majerowski et al.
6,554,009 B1 4/2003 Beijbom et al.
D474,528 S 5/2003 Huang
6,585,173 B2 7/2003 Schmon et al.
6,595,441 B2 7/2003 Petrie et al.
6,626,382 B1 9/2003 Liu
6,626,383 B1 9/2003 Campbell
6,647,997 B2 11/2003 Mohn
6,661,438 B1 12/2003 Shiraishi et al.
D485,685 S 1/2004 Zupkofska et al.
6,675,845 B2 1/2004 Volpenheim et al.
6,692,118 B2 2/2004 Michele et al.
6,712,292 B1 3/2004 Gosis et al.
6,717,584 B2 4/2004 Kulczycka
6,732,751 B2 5/2004 Chiang
6,763,964 B1 * 7/2004 Hurlbut et al. ..... 220/254.3
6,766,763 B2 7/2004 Crum et al.
6,786,345 B2 9/2004 Richards
6,796,514 B1 * 9/2004 Schwartz ..... 239/345
6,801,211 B2 10/2004 Forsline et al.
6,820,824 B1 11/2004 Joseph et al.
6,843,390 B1 1/2005 Bristor
6,845,924 B2 1/2005 Schmon
6,855,173 B2 2/2005 Ehrnsperger et al.
6,863,310 B1 3/2005 Petkovsek
6,863,920 B2 3/2005 Crum et al.
6,874,656 B2 4/2005 Rohr et al.
6,874,664 B1 4/2005 Montgomery
6,874,708 B2 4/2005 Reetz, III
6,877,677 B2 4/2005 Schmon et al.
6,929,019 B2 8/2005 Weinmann
6,945,429 B2 9/2005 Gosis et al.
6,955,180 B2 10/2005 Kocherlakota et al.
6,962,432 B2 11/2005 Hofeldt
6,963,331 B1 11/2005 Kobayashi et al.
7,017,838 B2 3/2006 Schmon
7,018,154 B2 3/2006 Schmon
D519,687 S 4/2006 Zahav
7,036,752 B1 5/2006 Hsiang
7,083,119 B2 8/2006 Bouic et al.
7,090,148 B2 8/2006 Petrie et al.
7,097,118 B1 8/2006 Huang
D528,192 S 9/2006 Nicholson
7,106,343 B1 9/2006 Hickman
7,165,732 B2 1/2007 Kosmyna et al.
7,172,139 B2 2/2007 Bouic
7,175,110 B2 2/2007 Vicentini
7,182,213 B2 2/2007 King
D538,050 S 3/2007 Tardif
D538,493 S 3/2007 Zimmerle et al.
D538,886 S 3/2007 Huang
7,194,829 B2 3/2007 Boire et al.
D541,053 S 4/2007 Sanders
D541,088 S 4/2007 Nesci
7,201,336 B2 4/2007 Blette et al.
7,216,813 B2 5/2007 Rogers
D545,943 S 7/2007 Rodgers et al.
7,246,713 B2 7/2007 King
7,249,519 B2 7/2007 Rogers
D548,816 S 8/2007 Schmon
7,255,293 B2 8/2007 Dodd
7,264,131 B2 9/2007 Tsutsumi et al.
D552,213 S 10/2007 Schmon
D552,715 S 10/2007 Schmon
D554,703 S 11/2007 Josephson
D563,505 S 3/2008 Schmon
7,374,111 B2 5/2008 Joseph et al.
D571,463 S 6/2008 Chesnin
7,384,004 B2 6/2008 Rogers
RE40,433 E 7/2008 Schmon
D573,227 S 7/2008 Mirazita et al.
D574,926 S 8/2008 Huang
D575,374 S 8/2008 Huang
7,410,106 B2 8/2008 Escoto, Jr. et al.
7,416,140 B2 8/2008 Camilleri et al.
7,422,164 B2 9/2008 Matsumoto
D579,213 S 10/2008 Aipa
D581,107 S 11/2008 Schmon
D581,483 S 11/2008 Bass et al.
D583,013 S 12/2008 Wang
7,458,612 B1 12/2008 Bennett
D588,231 S 3/2009 Pellin
7,533,678 B2 5/2009 Rosa
7,540,434 B2 6/2009 Gohring et al.
7,542,032 B2 6/2009 Kruse

(56) References Cited

U.S. PATENT DOCUMENTS

| | | | |
|---|---|---|---|
| 7,568,638 | B2 | 8/2009 | Gehrung |
| D604,394 | S | 11/2009 | Wang |
| 7,614,571 | B2 | 11/2009 | Camilleri et al. |
| D607,086 | S | 12/2009 | Kosaka |
| 7,624,869 | B2 | 12/2009 | Primer |
| D607,972 | S | 1/2010 | Wang |
| D608,858 | S | 1/2010 | Baltz et al. |
| D614,731 | S | 4/2010 | Wang |
| 7,694,893 | B2 | 4/2010 | Zittel et al. |
| 7,694,896 | B2 | 4/2010 | Turnbull et al. |
| D615,586 | S | 5/2010 | Kudimi |
| D616,022 | S | 5/2010 | Kudimi |
| D616,527 | S | 5/2010 | Anderson et al. |
| 7,765,876 | B1 | 8/2010 | Chen |
| D624,668 | S | 9/2010 | Noppe |
| 7,810,744 | B2 | 10/2010 | Schmon et al. |
| 7,819,341 | B2 | 10/2010 | Schmon et al. |
| D627,039 | S | 11/2010 | Yu |
| D627,432 | S | 11/2010 | Escoto et al. |
| 7,823,806 | B2 | 11/2010 | Schmon |
| D629,623 | S | 12/2010 | Lampe |
| 7,856,940 | B2 | 12/2010 | Wendler |
| 7,913,938 | B2 | 3/2011 | Cooper |
| 7,922,107 | B2 | 4/2011 | Fox |
| D637,269 | S | 5/2011 | Wang |
| D638,121 | S | 5/2011 | Villasana |
| D639,863 | S | 6/2011 | Langan |
| D641,067 | S | 7/2011 | Wang |
| D644,716 | S | 9/2011 | Gehrung |
| D644,803 | S | 9/2011 | Schmon |
| D645,094 | S | 9/2011 | Langan |
| 8,042,402 | B2 | 10/2011 | Brown et al. |
| D649,196 | S | 11/2011 | Langan |
| 8,052,071 | B2 | 11/2011 | Kruse |
| D655,347 | S | 3/2012 | Gehrung |
| 8,127,963 | B2 | 3/2012 | Gerson et al. |
| D657,276 | S | 4/2012 | Brose |
| D661,492 | S | 6/2012 | Ranschau |
| D661,742 | S | 6/2012 | Clark |
| D663,960 | S | 7/2012 | Jeronimo |
| 8,225,892 | B2 | 7/2012 | Ben-Tzvi |
| D664,773 | S | 8/2012 | Papin |
| 8,240,579 | B1 | 8/2012 | Bennett |
| 8,297,536 | B2 | 10/2012 | Ruda |
| D670,085 | S | 11/2012 | Brookman |
| D671,988 | S | 12/2012 | Leipold |
| D672,012 | S | 12/2012 | Brose |
| D674,880 | S | 1/2013 | Schmon |
| 8,352,744 | B2 | 1/2013 | Kruse |
| 8,360,345 | B2 | 1/2013 | Micheli |
| D681,162 | S | 4/2013 | Kruse |
| 8,444,067 | B2 | 5/2013 | Schmon et al. |
| 8,454,759 | B2 | 6/2013 | Selsvik |
| 8,481,124 | B2 | 7/2013 | Nolte et al. |
| D689,590 | S | 9/2013 | Brose |
| D689,593 | S | 9/2013 | Schmon |
| D690,799 | S | 10/2013 | Maier |
| D692,530 | S | 10/2013 | Gehrung |
| D692,532 | S | 10/2013 | Li et al. |
| 8,616,434 | B2 | 12/2013 | Wilen |
| D697,584 | S | 1/2014 | Schmon |
| D698,008 | S | 1/2014 | Schmon et al. |
| 8,626,674 | B2 | 1/2014 | Whitehouse |
| 8,642,131 | B2 | 2/2014 | Nolte et al. |
| D704,300 | S | 5/2014 | Li |
| 8,757,182 | B2 | 6/2014 | Schmon |
| 8,807,460 | B2 | 8/2014 | Charpie et al. |
| 8,857,732 | B2 | 10/2014 | Brose |
| D720,015 | S | 12/2014 | Kruse |
| D720,041 | S | 12/2014 | Robinson |
| 8,899,501 | B2 | 12/2014 | Fox et al. |
| D721,785 | S | 1/2015 | Gehrung |
| 8,925,836 | B2 | 1/2015 | Dettlaff |
| D733,369 | S | 6/2015 | Tschan |
| D733,453 | S | 7/2015 | Tschan |
| D734,571 | S | 7/2015 | Tschan |
| 9,073,068 | B2 | 7/2015 | Krayer et al. |
| D737,126 | S | 8/2015 | Tschan |
| D740,393 | S | 10/2015 | Gehrung |
| D745,636 | S | 12/2015 | Lin |
| D757,216 | S | 5/2016 | Gherung |
| D758,533 | S | 6/2016 | Gehrung |
| D758,537 | S | 6/2016 | Gehrung |
| D768,820 | S | 10/2016 | Binz |
| D770,593 | S | 11/2016 | Gehrung |
| 2001/0004996 | A1 | 6/2001 | Schmon |
| 2001/0040192 | A1 | 11/2001 | Kaneko et al. |
| 2002/0134861 | A1 | 9/2002 | Petrie et al. |
| 2002/0148501 | A1 | 10/2002 | Shieh |
| 2002/0170978 | A1 | 11/2002 | Mohn |
| 2003/0025000 | A1 | 2/2003 | Schmon et al. |
| 2003/0066218 | A1 | 4/2003 | Schweikert |
| 2003/0121476 | A1 | 7/2003 | McIntyre et al. |
| 2003/0127046 | A1 | 7/2003 | Zehner et al. |
| 2003/0164408 | A1 | 9/2003 | Schmon |
| 2003/0177979 | A1 | 9/2003 | Crum et al. |
| 2003/0189105 | A1 | 10/2003 | Schmon |
| 2003/0209568 | A1 | 11/2003 | Douglas et al. |
| 2003/0213857 | A1 | 11/2003 | Schmon et al. |
| 2003/0218596 | A1 | 11/2003 | Eschler |
| 2003/0230636 | A1 | 12/2003 | Rogers |
| 2004/0046051 | A1 | 3/2004 | Santa Cruz et al. |
| 2004/0050432 | A1 | 3/2004 | Breda |
| 2004/0104194 | A1 | 6/2004 | Dennison |
| 2004/0129738 | A1 | 7/2004 | Stukas |
| 2004/0140373 | A1 | 7/2004 | Joseph et al. |
| 2004/0155063 | A1 | 8/2004 | Hofeldt |
| 2004/0177890 | A1 | 9/2004 | Weinmann |
| 2004/0191406 | A1 | 9/2004 | Crum et al. |
| 2004/0217201 | A1 | 11/2004 | Ruda |
| 2004/0233223 | A1 | 11/2004 | Schkolne et al. |
| 2004/0245208 | A1 | 12/2004 | Dennison |
| 2005/0056613 | A1 | 3/2005 | King |
| 2005/0082249 | A1 | 4/2005 | King |
| 2005/0127201 | A1 | 6/2005 | Matsumoto |
| 2005/0145723 | A1 | 7/2005 | Blette et al. |
| 2005/0145724 | A1 | 7/2005 | Blette et al. |
| 2005/0178854 | A1 | 8/2005 | Dodd |
| 2005/0220943 | A1 | 10/2005 | Abrams et al. |
| 2005/0248148 | A1 | 11/2005 | Schenck et al. |
| 2005/0252993 | A1 | 11/2005 | Rogers |
| 2005/0252994 | A1 | 11/2005 | Rogers |
| 2005/0268949 | A1 | 12/2005 | Rosa |
| 2005/0284963 | A1 | 12/2005 | Reedy |
| 2006/0000927 | A1 | 1/2006 | Ruda |
| 2006/0007123 | A1 | 1/2006 | Wilson et al. |
| 2006/0048803 | A1 | 3/2006 | Jessup et al. |
| 2006/0081060 | A1 | 4/2006 | Forster |
| 2006/0113409 | A1 | 6/2006 | Camilleri |
| 2006/0171771 | A1 | 8/2006 | Kruse |
| 2006/0192377 | A1 | 8/2006 | Bauer et al. |
| 2006/0196891 | A1 | 9/2006 | Gerson et al. |
| 2007/0029788 | A1 | 2/2007 | Adler |
| 2007/0055883 | A1 | 3/2007 | Kruse |
| 2007/0131795 | A1 | 6/2007 | Abbate et al. |
| 2007/0158349 | A1 | 7/2007 | Schmon |
| 2007/0205305 | A1 | 9/2007 | Vagedes |
| 2007/0221754 | A1 | 9/2007 | Gehrung |
| 2007/0252378 | A1 | 11/2007 | Chambers |
| 2008/0011879 | A1 | 1/2008 | Gerson et al. |
| 2008/0019789 | A1 | 1/2008 | Dunaway et al. |
| 2008/0029619 | A1 | 2/2008 | Gohring et al. |
| 2008/0128533 | A1 | 6/2008 | Gehrung |
| 2008/0179763 | A1 | 7/2008 | Schmon et al. |
| 2008/0251977 | A1 | 10/2008 | Naruse et al. |
| 2008/0264892 | A1 | 10/2008 | Nozawa |
| 2008/0272213 | A1 | 11/2008 | Ting |
| 2008/0296410 | A1 | 12/2008 | Carey et al. |
| 2009/0014557 | A1 | 1/2009 | Schmon et al. |
| 2009/0026290 | A1 | 1/2009 | Fox |
| 2009/0045623 | A1 | 2/2009 | Schmon |
| 2009/0072050 | A1 | 3/2009 | Ruda |
| 2009/0078789 | A1 | 3/2009 | Kruse |
| 2009/0078790 | A1 | 3/2009 | Camilleri |

(56) References Cited

U.S. PATENT DOCUMENTS

| | | | |
|---|---|---|---|
| 2009/0143745 | A1 | 6/2009 | Langan et al. |
| 2009/0183516 | A1 | 7/2009 | Appler et al. |
| 2009/0235864 | A1 | 9/2009 | Khoury et al. |
| 2009/0266915 | A1 | 10/2009 | Fedorov |
| 2010/0021646 | A1 | 1/2010 | Nolte et al. |
| 2010/0059533 | A1 | 3/2010 | Unger et al. |
| 2010/0084493 | A1 | 4/2010 | Troudt |
| 2010/0108783 | A1 | 5/2010 | Joseph et al. |
| 2010/0126541 | A1 | 5/2010 | Schmon |
| 2010/0206963 | A1 | 8/2010 | Huang |
| 2011/0024524 | A1 | 2/2011 | Fox |
| 2011/0125607 | A1 | 5/2011 | Wilen |
| 2011/0121103 | A1 | 6/2011 | Carleton et al. |
| 2011/0127767 | A1 | 6/2011 | Wicks et al. |
| 2011/0168811 | A1 | 7/2011 | Fox et al. |
| 2011/0174901 | A1 | 7/2011 | Dettlaff et al. |
| 2012/0012671 | A1 | 1/2012 | Brose et al. |
| 2012/0097762 | A1 | 4/2012 | Gehrung et al. |
| 2012/0132550 | A1 | 5/2012 | Gerson et al. |
| 2012/0160935 | A1 | 6/2012 | Krayer et al. |
| 2012/0187220 | A1 | 7/2012 | Micheli et al. |
| 2013/0056556 | A1 | 3/2013 | Schmon et al. |
| 2013/0074864 | A1 | 3/2013 | Nuzzo et al. |
| 2013/0266734 | A1 | 10/2013 | Nolte et al. |
| 2013/0320110 | A1 | 12/2013 | Brose et al. |
| 2014/0048627 | A1 | 2/2014 | Schmon et al. |
| 2014/0059905 | A1 | 3/2014 | Raming |
| 2014/0145003 | A1 | 5/2014 | Schmon et al. |
| 2014/0305962 | A1 | 10/2014 | Tschan |
| 2015/0165463 | A1 | 6/2015 | Gehrung |
| 2015/0231655 | A1 | 8/2015 | Adams et al. |
| 2016/0030960 | A1 | 2/2016 | Gehrung |

FOREIGN PATENT DOCUMENTS

| | | | |
|---|---|---|---|
| AT | 250467 | | 10/2003 |
| AT | 322645 | | 4/2006 |
| AT | 383910 | | 2/2008 |
| AT | 461752 | | 4/2010 |
| AT | 461753 | | 4/2010 |
| AT | 475488 | | 8/2010 |
| AU | 637187 | | 5/1993 |
| AU | 2002352235 | | 9/2003 |
| AU | 2004315547 | | 8/2005 |
| AU | 2005205899 | | 8/2005 |
| AU | 2011257605 | | 11/2012 |
| AU | 2011361295 | | 5/2013 |
| CA | 521511 | | 2/1956 |
| CA | 2126957 | | 1/1995 |
| CA | 2277096 | | 7/1998 |
| CA | 2445183 | | 10/2002 |
| CA | 2552390 | | 8/2005 |
| CA | 2555607 | | 8/2005 |
| CA | 2690112 | | 5/2009 |
| CA | 2797990 | | 12/2011 |
| CA | 2812684 | | 9/2012 |
| CA | 102917803 | | 2/2013 |
| CA | 2850401 | A1 | 5/2013 |
| CH | 203 668 | | 6/1939 |
| CH | 542104 | A | 9/1973 |
| CH | 676208 | | 12/1990 |
| CN | 2136077 | Y | 6/1993 |
| CN | 1902002 | | 1/2007 |
| CN | 1909970 | | 2/2007 |
| CN | 1909971 | | 2/2007 |
| CN | 1917960 | | 2/2007 |
| CN | 200954482 | | 10/2007 |
| CN | 101125316 | | 2/2008 |
| CN | 100430150 | | 11/2008 |
| CN | 100455360 | | 1/2009 |
| CN | 101367066 | | 2/2009 |
| CN | 100478080 | | 4/2009 |
| CN | 101646500 | | 2/2010 |
| CN | 102211070 | | 4/2011 |
| CN | 102211069 | | 10/2011 |
| DE | 460381 | | 5/1928 |
| DE | 510362 | | 10/1930 |
| DE | 1425890 | | 11/1968 |
| DE | 2559036 | | 9/1976 |
| DE | 2653981 | | 6/1978 |
| DE | 2950341 | | 7/1980 |
| DE | 3016419 | | 11/1981 |
| DE | 8024829.9 | | 9/1982 |
| DE | 34 02 097 | | 8/1985 |
| DE | 3402945 | A1 | 8/1985 |
| DE | 3517122 | | 5/1986 |
| DE | 3505618 | | 8/1986 |
| DE | 3526819 | | 2/1987 |
| DE | 3016419 | C2 | 8/1987 |
| DE | 8702559 | | 10/1987 |
| DE | 3708472 | A1 | 10/1988 |
| DE | 8902223 | | 5/1989 |
| DE | 3742308 | | 6/1989 |
| DE | 8905681 | | 11/1989 |
| DE | G 90 01 265 | | 5/1990 |
| DE | 3906219 | | 8/1990 |
| DE | 4302911 | | 8/1993 |
| DE | 4230535 | | 3/1994 |
| DE | 4321940 | | 1/1995 |
| DE | 19516485 | | 11/1996 |
| DE | 19727884 | | 2/1999 |
| DE | 69505433 | T2 | 4/1999 |
| DE | 19807973 | | 7/1999 |
| DE | 19824264 | | 12/1999 |
| DE | 19832990 | | 1/2000 |
| DE | 20000483 | | 8/2000 |
| DE | 10004105 | | 10/2000 |
| DE | 19958569 | | 2/2001 |
| DE | 199 41 362 | | 3/2001 |
| DE | 199 45 760 | | 3/2001 |
| DE | 19945760 | | 3/2001 |
| DE | 10031857 | | 1/2002 |
| DE | 10031858 | | 1/2002 |
| DE | 20114257 | | 2/2002 |
| DE | 10059406 | | 6/2002 |
| DE | 10135104 | | 9/2002 |
| DE | 102 05 831 | | 8/2003 |
| DE | 10205831 | | 8/2003 |
| DE | 103 11 238 | | 10/2004 |
| DE | 10311238 | | 10/2004 |
| DE | 10 2004 027 789 | | 2/2005 |
| DE | 29825120 | | 2/2005 |
| DE | 102004027789 | A1 | 2/2005 |
| DE | 298 25 120 | | 3/2005 |
| DE | 20320781 | | 5/2005 |
| DE | 203 20 781 | | 6/2005 |
| DE | 20320781 | | 6/2005 |
| DE | 10 2004 014 646 | | 7/2005 |
| DE | 10 2004 014646 | | 7/2005 |
| DE | 10 2004 003 438 | | 8/2005 |
| DE | 102004003439 | | 8/2005 |
| DE | 10 2004 007 733 | | 9/2005 |
| DE | 10 2004 007733 | | 9/2005 |
| DE | 10 2004 021 298 | | 11/2005 |
| DE | 10 2004 021298 | | 11/2005 |
| DE | 69535077 | T2 | 11/2006 |
| DE | 202007001031 | | 3/2007 |
| DE | 60200500 1173 | | 8/2007 |
| DE | 60206956 | T2 | 8/2008 |
| DE | 102007006547 | | 8/2008 |
| DE | 102007039106 | | 2/2009 |
| DE | 102007052067 | | 5/2009 |
| DE | 20 2010 012 449 | U1 | 12/2010 |
| DE | 202010012449 | | 12/2010 |
| DE | 102009053449 | | 2/2011 |
| DE | 102010060086 | | 4/2012 |
| DE | 102011106060 | | 1/2013 |
| DE | 102011118120 | | 5/2013 |
| EP | 0092392 | | 10/1983 |
| EP | 524408 | | 1/1993 |
| EP | 567325 | | 10/1993 |
| EP | 0631821 | | 1/1995 |
| EP | 0650766 | | 5/1995 |
| EP | 678334 | | 10/1995 |

(56) References Cited

FOREIGN PATENT DOCUMENTS

| | | | |
|---|---|---|---|
| EP | 0706832 | | 4/1996 |
| EP | 0710506 | | 5/1996 |
| EP | 801002 | | 10/1997 |
| EP | 987060 | | 3/2000 |
| EP | 1081639 | | 3/2001 |
| EP | 1106262 | | 6/2001 |
| EP | 1247586 | | 10/2002 |
| EP | 1277519 | | 1/2003 |
| EP | 1294490 | | 3/2003 |
| EP | 1299194 | | 4/2003 |
| EP | 1366823 | | 12/2003 |
| EP | 1412669 | | 4/2004 |
| EP | 1424135 | | 6/2004 |
| EP | 1477232 | A1 | 11/2004 |
| EP | 1479447 | A1 | 11/2004 |
| EP | 1504823 | A1 | 2/2005 |
| EP | 1 563 913 | | 8/2005 |
| EP | 1563913 | | 8/2005 |
| EP | 1574262 | | 9/2005 |
| EP | 1602412 | | 12/2005 |
| EP | 1658902 | A1 | 5/2006 |
| EP | 1708822 | | 10/2006 |
| EP | 1708823 | | 10/2006 |
| EP | 1718415 | | 11/2006 |
| EP | 1880771 | A1 | 1/2008 |
| EP | 1902766 | A1 | 3/2008 |
| EP | 1902786 | | 3/2008 |
| EP | 1902876 | | 3/2008 |
| EP | 1930084 | | 6/2008 |
| EP | 1964616 | | 9/2008 |
| EP | 1964616 | A2 | 9/2008 |
| EP | 1997561 | A2 | 12/2008 |
| EP | 2017010 | A2 | 1/2009 |
| EP | 2027931 | | 2/2009 |
| EP | 2106298 | | 10/2009 |
| EP | 2111920 | | 10/2009 |
| EP | 2490819 | | 8/2012 |
| EP | 2576079 | | 4/2013 |
| EP | 2608890 | | 7/2013 |
| EP | 2703089 | A1 | 3/2014 |
| FR | 398333 | | 6/1909 |
| FR | 789762 | | 11/1935 |
| FR | 1410519 | | 9/1964 |
| FR | 2444501 | | 7/1980 |
| FR | 2462200 | A1 | 2/1981 |
| FR | 2 570 140 | | 3/1986 |
| FR | 2 774 928 | | 8/1999 |
| FR | 2927824 | A1 | 8/2009 |
| GB | 190900523 | | 6/1909 |
| GB | 2 132 916 | | 7/1984 |
| GB | 2153260 | | 8/1985 |
| GB | 2372465 | | 8/2002 |
| GB | 2411235 | | 8/2005 |
| HK | 1100405 | | 6/2009 |
| HK | 1096057 | | 7/2009 |
| HK | 1125067 | | 8/2012 |
| HK | 1138533 | | 11/2012 |
| JP | S49-136868 | U | 11/1974 |
| JP | S55-107258 | U | 7/1980 |
| JP | S5654328 | | 5/1981 |
| JP | S57-75246 | | 5/1982 |
| JP | S57128346 | A | 8/1982 |
| JP | 58-119862 | | 5/1983 |
| JP | S5998757 | | 6/1984 |
| JP | S601722 | | 1/1985 |
| JP | H01-87805 | | 6/1989 |
| JP | H0530749 | | 4/1993 |
| JP | H05172678 | | 7/1993 |
| JP | 674850 | | 3/1994 |
| JP | H06215741 | | 8/1994 |
| JP | H08196950 | | 8/1996 |
| JP | H09117697 | | 5/1997 |
| JP | 11-047643 | A | 2/1999 |
| JP | 2001259487 | | 9/2001 |
| JP | 2003042882 | | 2/2002 |
| JP | 2003088780 | | 3/2003 |
| JP | 2004017044 | | 1/2004 |
| JP | 2005138885 | | 6/2005 |
| JP | 2007516831 | | 6/2007 |
| JP | 2010-528837 | A | 8/2010 |
| TW | 491092 | | 6/2002 |
| TW | I220392 | | 8/2004 |
| TW | I303587 | | 12/2008 |
| TW | I309584 | | 5/2009 |
| WO | 90/008456 | | 8/1990 |
| WO | 91/16610 | | 10/1991 |
| WO | 1992/07346 | | 4/1992 |
| WO | 9522409 | | 8/1995 |
| WO | 98-32539 | | 7/1998 |
| WO | 1998/32539 | | 7/1998 |
| WO | WO 98/32539 | | 7/1998 |
| WO | 01/012337 | | 2/2001 |
| WO | 2001/12337 | | 2/2001 |
| WO | 0166261 | | 9/2001 |
| WO | 01/099062 | | 12/2001 |
| WO | 02/000355 | | 1/2002 |
| WO | 0202242 | | 1/2002 |
| WO | 02/018061 | | 3/2002 |
| WO | 02/085533 | | 10/2002 |
| WO | 03/007252 | | 1/2003 |
| WO | 03/045575 | | 6/2003 |
| WO | 03/069208 | | 8/2003 |
| WO | 03069208 | A1 | 8/2003 |
| WO | 04/037433 | | 5/2004 |
| WO | 2004/37433 | | 5/2004 |
| WO | 04/052552 | | 6/2004 |
| WO | 05/018815 | | 3/2005 |
| WO | 2005/018815 | | 3/2005 |
| WO | WO 2005/018815 | | 3/2005 |
| WO | 05/068220 | | 7/2005 |
| WO | 05/070557 | | 8/2005 |
| WO | 05/070558 | | 8/2005 |
| WO | 05/077543 | | 8/2005 |
| WO | 05/115631 | | 12/2005 |
| WO | 2006065850 | | 6/2006 |
| WO | 07/128127 | | 11/2007 |
| WO | 2007133386 | A2 | 11/2007 |
| WO | 2007/149760 | A2 | 12/2007 |
| WO | 2009015260 | | 1/2009 |
| WO | 2009015260 | A2 | 1/2009 |
| WO | 2009056424 | | 5/2009 |
| WO | 2010019274 | A1 | 2/2010 |
| WO | 2011047876 | | 4/2011 |
| WO | 2011147555 | | 12/2011 |
| WO | 2012119664 | | 9/2012 |
| WO | 2013000524 | | 1/2013 |
| WO | 2013016474 | | 1/2013 |

OTHER PUBLICATIONS

Printout from Internet www.alsacorp.com showing in the paragraph bridging pp. 2 and 3, Model VS-7200 Saber LVLP spray gun with nozzle size 1.3 mm with sizes 1.3 to 2.0 available, printed Aug. 26, 2012 (EXHIBIT 1026 in IPR 2013-0111).

Printout from Internet p. 28 from current 3Mtm brochure showing Tip/Nozzle/Air Cap Selection Guide with nozzle sizes from 0.5 mm to 3.0 mm., (EXHIBIT 1027 in IPR 2013-0111).

Decision by EPO regarding opposition proceedings to revoke patent No. 99926841.0-2425/ 1108476, corresponding to '387 patent, 2012, (EXHIBIT 1029 in IPR 2013-0111).

SATA News Publication Dan-Am Jul.-Sep. 1996, (EXHIBIT 1034 in IPR 2013-0111).

SATA News Publication Dan-Am Oct.-Dec. 1996, (EXHIBIT 1035 in IPR 2013-0111).

SATA News Publication Dan-Am Apr.-Jun. 1998 (EXHIBIT 1036 in IPR 2013-0111).

Dan-Am SATA Catalog 6 for spray guns 1991 (EXHIBIT 1037 in IPR 2013-0111).

Dan-Am SATA Catalog 8 for spray guns 1994 (EXHIBIT 1038 in IPR 2013-0111).

Dan-Am Catalog 6—51pp published 1991, (EXHIBIT 1042 in IPR 2013-0111).

(56) References Cited

OTHER PUBLICATIONS

Japanese Industrial Standards B 9809 English translation, 1992 (EXHIBIT 1049 in IPR 2013-0111).
Japanese Industrial Standards B 9809 revised Mar. 1, 1991 (EXHIBIT 1050 in IPR 2013-0111).
SATA News, vol. 21, 2009 (EXHIBIT 2010 in IPR 2013-0111).
Collision Hub TV Document (image from video clip) printed Oct. 9, 2013 (EXHIBIT 2011 in IPR 2013-0111).
MyRieIsMe.com document from press release printed Oct. 9, 2013 (EXHIBIT 2012 in IPR 2013-0111).
How to set Air pressure, Utube screenshot printed Oct. 9, 2013 (EXHIBIT 2013 in IPR 2013-0111).
Ohio EPA Letty to Tony Larimer, response to letter dated Aug. 2006 (EXHIBIT 2014 in IPR 2013-0111).
Pinahs Ben-Tzvi et al, A conceptual design . . . , Mechatrronics 17 (2007) p. 1-13 (EXHIBIT 2015 in IPR 2013-0111).
On line ad from Amazon.com printed Oct. 14, 2013 (EXHIBIT 2017 in IPR 2013-0111).
Rone et al, MEMS-Baed Microdroplet Generation with Integrated Sensing, COMSOL, 2011 (EXHIBIT 2018 in IPR 2013-0111).
Response filed Nov. 25, 2015 to Office Action dated Aug. 27, 2015 for Design U.S. Appl. No. 29/530,038.
Response filed Nov. 30, 2015 to Office Action dated Aug. 28, 2015 for Design U.S. Appl. No. 29/530,045.
Response filed Dec. 3, 2015 to Office Action dated Sep. 3, 2015 Design U.S. Appl. No. 29/530,047 filed Jun. 12, 2015.
Response filed Nov. 30, 2015 to Office Action dated Aug. 28, 2015 for Design U.S. Appl. No. 29/530,052.
International Search Report (dated Jun. 20, 2008), Written Opinion (dated Jun. 20, 2008), and International Preliminary Report on Patentability (dated Sep. 14, 2010) from PCT/US2008/03318 filed Mar. 12, 2008.
Response filed Dec. 7, 2015 to Office Action dated Aug. 7, 2015 for U.S. Appl. No. 13/991,285.
Notice of Allowance dated Jan. 27, 2016 for Design U.S. Appl. No. 29/510,723 (92).
Response to Office Action filed Feb. 16, 2016 for U.S. Appl. No. 13/698,417 (17).
Screen shot of a SATA product (SATAjet B) description retrieved on Feb. 12, 2016 from www.sata.com/index.php (17).
"The Hot Rolling Process;" California Steel; retrieved on Feb. 12, 2016 from http://www.californiasteel.com/GetPublicFile.aspx?id=53 (17).
Office Action dated Feb. 19, 2016 for U.S. Appl. No. 14/113,649 (36).
Final Office Action dated Feb. 25, 2016 for U.S. Appl. No. 13/698,417 (17).
Restriction Requirement dated Mar. 25, 2016 for Design U.S. Appl. No. 29/516,082 (94).
Response filed Mar. 31, 2016 to Office Action dated Dec. 31, 2016 for U.S. Appl. No. 14/572,998 (87).
Canadian Office Action dated Nov. 21, 2012 for related application CA2741703.
Chinese Search Report dated Dec. 5, 2012 for related application CN200980135429.9.
Chinese Office Action dated Dec. 13, 2012 for related application CN200980135429.9.
German Search Report for DE 20 2008 014 389.6 completed Jul. 13, 2009.
Design U.S. Appl. No. 29/530,038, filed Jun. 12, 2015.
Office Action dated Aug. 27, 2015 for Design U.S. Appl. No. 29/530,038.
Design U.S. Appl. No. 29/530,045, filed Jun. 12, 2015.
Office Action dated Aug. 28, 2015 for Design U.S. Appl. No. 29/530,045.
Design U.S. Appl. No. 29/530,052, filed Jun. 12, 2015.
Office Action dated Aug. 28, 2015 for Design U.S. Appl. No. 29/530,052.
U.S. Appl. No. 14/249,596, filed Apr. 10, 2014.
Restriction Requirement dated Sep. 1, 2015 for U.S. Appl. No. 14/249,596.
Response filed Oct. 6, 2015 to Notice of Non-Compliant Amendment for U.S. Appl. No. 13/698,417.
Notice of Non-Compliant Amendment dated Aug. 10, 2015 for U.S. Appl. No. 13/698,417.
Final Office Action dated Oct. 16, 2015 for U.S. Appl. No. 13/698,417.
Design U.S. Appl. No. 29/530,047, filed Jun. 12, 2015.
Office Action dated Sep. 2, 2015 Design U.S. Appl. No. 29/530,047, filed Jun. 12, 2015.
Extended European Search Report dated Apr. 17, 2015 for European Application No. 14004167.4.
Response Office Action filed Nov. 2, 2015 for U.S. Appl. No. 14/249,596.
International Search Report, Written Opinion and International Preliminary Report on Patentability for PCT/EP2004/005381 file May 19, 2004.
International Search Report, Written Opinion and International Preliminary Report on Patentability for PCT/EP2004/011998 filed Oct. 23, 2004.
International Search Report, Written Opinion and International Preliminary Report on Patentability for PCT/EP2005/000435 filed Jan. 18, 2005.
International Search Report, Written Opinion and International Preliminary Report on Patentability for PCT/EP2005/00437 filed Jan. 18, 2005.
International Search Report, Written Opinion and International Preliminary Report on Patentability for PCT/EP2008/063344, filed Oct. 6, 2008.
International Search Report, Written Opinion and International Preliminary Report on Patentability for PCT/EP2010/002392 filed Apr. 20, 2010.
International Search Report, Written Opinion and International Preliminary Report on Patentability for PCT/EP2011/002544 filed May 21, 2011.
International Search Report, Written Opinion and International Preliminary Report on Patentability for PCT/EP2011/066665 filed Sep. 26, 2011.
International Search Report, Written Opinion and International Preliminary Report on Patentability for PCT/EP2010/003399 filed Jun. 7, 2010.
International Search Report, Written Opinion and International Preliminary Report on Patentability for PCT/EP2011/5842 filed Dec. 2, 2010.
International Search Report, Written Opinion and International Preliminary Report on Patentability for PCT/EP2012/01939 filed May 5, 2012.
International Search Report, Written Opinion and International Preliminary Report on Patentability for PCT/EP2009/06992 filed Sep. 29, 2009.
Internet Archive Wayback Machine [online] [captured Sep. 25, 2012] [retrieved on Sep. 8, 2014] retrieved from the Internet URL:http://web.archive.org/web/20120925210554/http://www.sata.com/index.php?id=sal-check&no cache=1&L=11.
JP Office Action issued agains JP Patent App. 2012-508926 dated Feb. 25, 2014 with English translation.
International Search Report published Sep. 17, 2009 for PCT/US2008/003318.
Response filed Dec. 21, 2015 to Office Action dated Jul. 20, 2015 for U.S. Appl. No. 14/113,649.
Office Action dated Dec. 31, 2015 for U.S. Appl. No. 14/572,998 (87).
Notice of Allowance dated Jan. 19, 2016 for Design U.S. Appl. No. 29/539,615 (69div).
Notice of Allowance dated Jan. 22, 2016 for U.S. Appl. No. 13/991,285 (26).
Notice of Allowance dated Apr. 18, 2016 for U.S. Appl. No. 14/572,998 (87).
Response filed Apr. 27, 2016 to Office Action dated Jan. 29, 2016 for U.S. Appl. No. 13/380,949 (8).
German Search Report dated Apr. 12, 2016 for related German Application No. 10 2015 008 735.5 (111).

(56) References Cited

OTHER PUBLICATIONS

Response restriction requirement filed May 23, 2016 for Design U.S. Appl. No. 29/516,082.
Application filed Dec. 2, 2014 for Design U.S. Appl. No. 29/510,723 (92).
Restriction Requirement dated Nov. 3, 2015 for Design U.S. Appl. No. 29/510,723 (92).
International Preliminary Report on Patentability dated Sep. 14, 2010 for PCT/US2008/003318, filed Mar. 12, 2008.
Written Opinion dated Jun. 20, 2008 for PCT/US2008/003318, filed Mar. 12, 2008.
Office Action dated Nov. 18, 2014 for U.S. Appl. No. 14/113,649.
Notice of Allowance dated Nov. 19, 2014 for U.S. Appl. No. 29/486,223.
Office Action dated Dec. 31, 2014 for U.S. Appl. No. 13/380,949.
Restriction Requirement dated Jan. 9, 2015 for Design U.S. Appl. No. 29/469,049.
Response to Office Action filed Dec. 2, 2014 for U.S. Appl. No. 29/487,679.
Notice of Allowance dated Jan. 15, 2015 for Design U.S. Appl. No. 29/490,620.
Office Action dated Jan. 14, 2015 for Design U.S. Appl. No. 29/447,887.
Hercules Paint Gun Washers brochure publish date Jan. 2012, [online], [site visited 1/7/15], <http://www.herkules.us/pdfs/L00761-Hercules-Gun_Washers-4-page-brochure.pdf>.
Jetclean GUn Cleaner Terry's Auto Supply, google publish date Aug. 4, 2011, [online], [site visited Jan. 7, 2015], <http://secure.terrys.net/viewProduct.php?productID=FT.FHAZ1005>.
Restriction Requirement dated Feb. 6, 2015 for Design U.S. Appl. No. 29/486,232.
Office Action dated Mar. 30, 2015 for U.S. Appl. No. 13/698,417.
Responde to Office Action filed Apr. 14, 2015 to Office Action dated Jan. 14, 2015 for U.S. Appl. No. 29/447,887.
Response filed Jul. 20, 2015 for Office Action dated Mar. 30, 2015 for U.S. Appl. No. 13/698,417.
Notice of Allowance dated Apr. 30, 2015 for U.S. Appl. No. 29/447,887.
Chinese Office Action dated Oct. 28, 2014 and Search Report dated Oct. 15, 2014 for Chinese Application No. 2011800266029.
Australian Examination Report dated Oct. 30, 2012 for Australian Application No. 2010268870.
Notice of Allowance dated Apr. 24, 2015 for Design U.S. Appl. No. 29/486,232.
Restriction Requirement dated Jan. 22, 2015 for U.S. Appl. No. 13/698,417.
Response filed Mar. 23, 2015 to Restriction Requirement dated Jan. 22, 2015 for U.S. Appl. No. 13/698,417.
Response filed Apr. 6, 2015 to Office Action dated Feb. 6, 2015 for Design U.S. Appl. No. 29/486,232.
Response filed Mar. 31, 2015 to Office Action dated Dec. 31, 2014 for U.S. Appl. No. 13/380,949.
Japanese Office Action dated Jun. 11, 2014 for Japanese Patent Application No. 2012-518769.
Australian Examination Report dated Nov. 11, 2014 for Australian patent Application No. 2011257605.
Japanese Notice of Allowance dated Jan. 13, 2015 for Japanese Patent Application No. 2012/518769.
Application filed Dec. 11, 2011 for U.S. Appl. No. 13/380,949.
Chinese Office Action dated Jan. 28, 2014 and Search Report dated Jan. 21, 2014 for Chinese Application No. 201080030935.4.
Search Report dated Apr. 24, 2010 for German Application No. 10 2009 032 399.6-51.
Application filed Oct. 24, 2013 for U.S. Appl. No. 14/113,649.
Response filed May 18, 2015 to Office Action dated Nov. 18, 2014 for U.S. Appl. No. 14/113,649.
Application filed Dec. 17, 2014 for U.S. Appl. No. 14/572,998.
German Search Report dated Mar. 25, 2014 for German Application No. 202013105779-7.
Application filed Nov. 16, 2012 for U.S. Appl. No. 13/698,417.
Application filed Jun. 2, 2013 for U.S. Appl. No. 13/991,285.
English translation of application filed Aug. 13, 2013 for Application filed Jun. 2, 2013 for U.S. Appl. No. 13/991,285.
Restriction Requirement dated May 27, 2015 for U.S. Appl. No. 13/991,285.
Application filed Jan. 29, 2015 for Design U.S. Appl. No. 29/516,073.
Application filed Jan. 29, 2015 for Design U.S. Appl. No. 29/516,082.
Application filed Mar. 3, 2015, 2015 for Design U.S. Appl. No. 29/519,198.
Final Office Action dated Jul. 20, 2015 for U.S. Appl. No. 14/113,649.
Response to Restriction Requirement filed Jul. 27, 2015 to Restriction Requirement dated May 27, 2015 for U.S. Appl. No. 13/991,285.
Application filed Jul. 31, 2015 for U.S. Appl. No. 14/815,210.
Final Office Action dated Aug. 4, 2015 for U.S. Appl. No. 13/380,949.
Notice of Allowance dated Aug. 3, 2015 for U.S. Appl. No. 29/486,232.
Office Action dated Aug. 7, 2015 for U.S. Appl. No. 13/991,285.
Second Chinese Office Action dated Jun. 24, 2015 for Chinese Application No. 2011800266029.
Third Chinese Office Action dated Nov. 30, 2015 for Chinese Application No. 2011800266029.
Final Office Action dated Aug. 29, 2016 for U.S. Appl. No. 14/113,649.
International Preliminary Report on Patentability for PCT/EP2015/001728 filed Aug. 25, 2015.
Final Office Action dated Mar. 16, 2017 from U.S. Appl. No. 13/698,417, 9 pages.
Notification of the First Office Action with search report dated Aug. 24, 2015 for Chinese Application No. 201280020519.5 (related to U.S. Appl. No. 14/113,649), 13 pages.
Notification of the Second Office Action dated May 16, 2016, for Chinese Application No. 201280020519.5 (related to U.S. Appl. No. 14/113,649), 5 pages.
Japanese Office Action for JP2014-517485 (related to U.S. Appl. No. 14/113,649), dated Jul. 5, 2016, 16 pages.
Office Action from U.S. Appl. No. 15/143,698 dated Jan. 5, 2017, 214 pages.
German Search Report for German Application No. 10 2015 016 474.0 dated Aug. 9, 2016, 14 pages.
Notice of Allowance in U.S. Appl. No. 29/556,463, filed Mar. 1, 2016, 9 pages.
Notice of Allowance in U.S. Appl. No. 29/555,656, filed Feb. 24, 2016, 9 pages.
Response to Final Office Action and RCE dated Nov. 29, 2016 in U.S. Appl. No. 14/113,649.

* cited by examiner

FLUID RESERVOIR FOR A PAINT SPRAY GUN

CROSS REFERENCE TO RELATED APPLICATION

This application claims priority under 35 U.S.C. §119 to German Patent Application No. 10 2006 057 621.7 filed Dec. 5, 2006, the entire contents of which are incorporated herein by reference.

FIELD OF THE INVENTION

The invention relates to a fluid reservoir for a paint spray gun.

BACKGROUND OF THE INVENTION

Such a fluid reservoir is known from the state of the art, for example, from WO 98/32539. This fluid reservoir is provided for one-time use and comprises a container made from plastic and a cover that can be set on top for closing this container. On the top side of the cover there are connection means for the placement and attachment of the fluid reservoir on a paint spray gun or an adapter attached to this gun. In this way, the fluid reservoir is set "upside-down" on the paint spray gun, that is, with the cover side pointing downward. The paint located in the fluid reservoir then flows downward into the paint inlet channel of the paint spray gun due to the force of gravity. Pressure equalization between the interior of the paint reservoir and the surroundings is necessary to allow the gravity-driven flow of paint. To guarantee this pressure equalization, a ventilation opening, which can be closed by means of an adhesive strip or a manually actuated valve, is formed in the container base.

Another fluid reservoir of this generic type is known from DE 10 2004 021 298 A1. For this fluid reservoir, the valve is constructed as a sliding valve for closing the ventilation opening. For such a sliding valve, there is the risk that the ventilation opening is not completely closed if the slider has not been completely pushed into the valve housing. In this case, there is the risk when filling the fluid reservoir with paint that paint will run out through the ventilation opening incompletely closed with the slide.

Starting with this state of the art, the invention is based on the task of presenting a fluid reservoir with a valve, easily actuated manually, for the reliable closing of the ventilation opening.

SUMMARY OF THE INVENTION

This task is achieved with a fluid reservoir as set forth in the claims. Advantageous embodiments of this fluid reservoir are to be taken from the dependent claims.

BRIEF DESCRIPTION OF THE DRAWINGS

The invention is explained in more detail below using an embodiment with reference to the enclosed drawings. The drawings show.

DETAILED DESCRIPTION OF THE INVENTION

Figure 1:
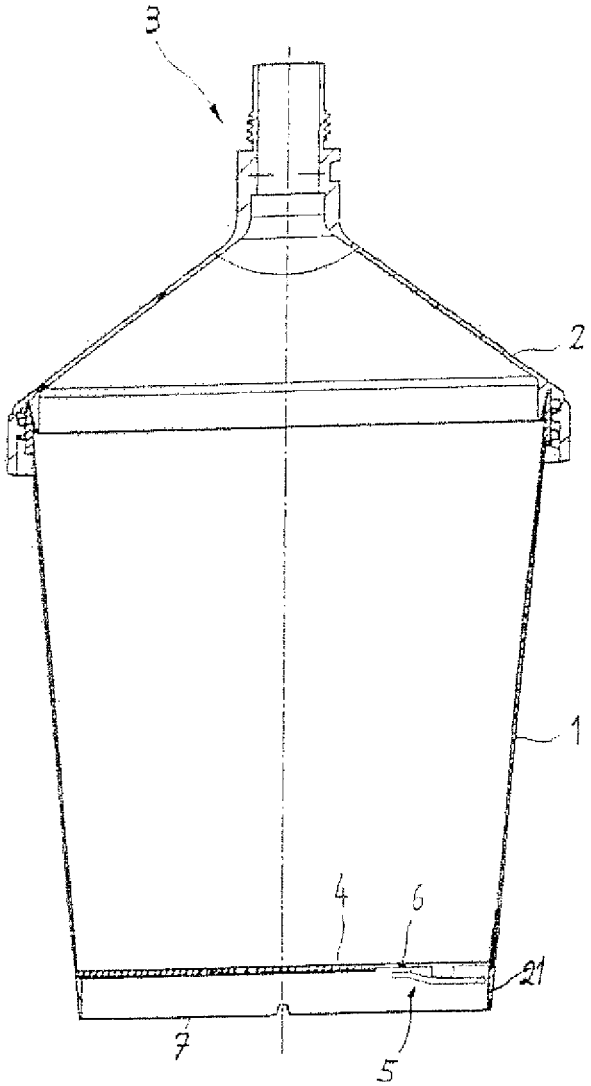
FIG. 1, a fluid reservoir according to the invention in section.

The fluid reservoir shown in FIG. 1 comprises a cup-shaped container 1 and a cover 2 that can be screwed onto this container by means of a thread. The cover 2 has an outlet port with an outlet opening on its top side. On the outside of the outlet port there is a connection part 3, which is used for the placement and attachment of the fluid reservoir on a paint spray gun or on an adapter arranged between the paint spray gun and the fluid reservoir. In the embodiment shown in FIG. 1, the connection part 3 comprises a thread and a wedge-shaped groove, which interact with corresponding connection parts on the paint spray gun, namely a corresponding internal thread and a pin for engaging in the groove. Both the container 1 and also the cover 2 are preferably constructed as injection-molded parts made from plastic.

For filling the container 1, the cover 2 is removed and then replaced after filling. Then the cover 2 is set and attached with its connection part 3 on the connection part of a paint spray gun or an adapter. During the spraying process, the fluid reservoir is located on the top side of the paint spray gun and the liquid in the container runs into the paint inlet channel of the paint spray gun due to the force of gravity.

To maintain the gravity-driven flow of the fluid, pressure equalization between the interior of the container 1 and the surroundings is necessary. For this reason, a ventilation opening 6 is provided in a wall 9 of the container 1. In the embodiment shown in the figures, the ventilation opening 6 is in the container base 4. Alternatively, however, the ventilation opening 6 can also be formed in the side wall of the container preferably in the vicinity of the base 4. For closing the ventilation opening 6, a valve 5 is provided that is arranged on the bottom side of the container base 4. In addition, a surrounding cylindrical rim 21 is formed on the outer periphery on the bottom side of the container base 4. This rim projects beyond the valve 5, in order to be able to set down the container 1 on the base 4 for filling.

The valve 5 is constructed as a rocking valve that has a closing element 8 that can pivot about a pivot axis 7 for closing the ventilation opening 6. The valve 5 is shown in detail views in FIGS. 2 and 3 wherein FIG. 2*a* shows the valve 5 in the closed valve position and FIG. 2*b* shows it in the open valve position, and FIGS. 3*a* and 3*b* shows the components of valve 5 in the form of exploded views.

Figure 2:
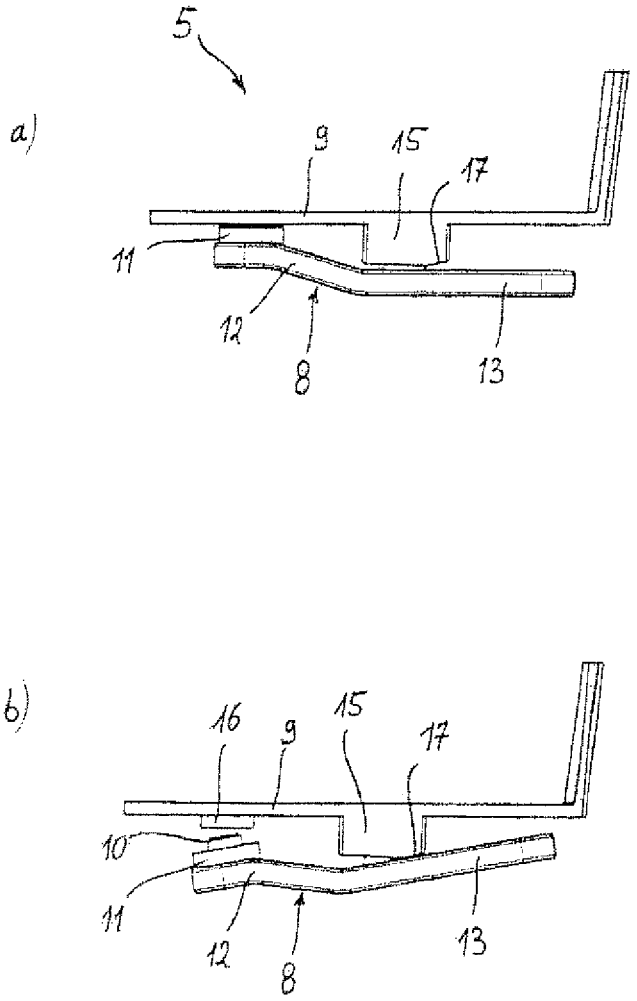
FIG. 2, detail view of the valve of the fluid reservoir of FIG. 1 in the closed valve position (FIG. 2*a*) and the open valve position (FIG. 2*b*)
Figure 3:
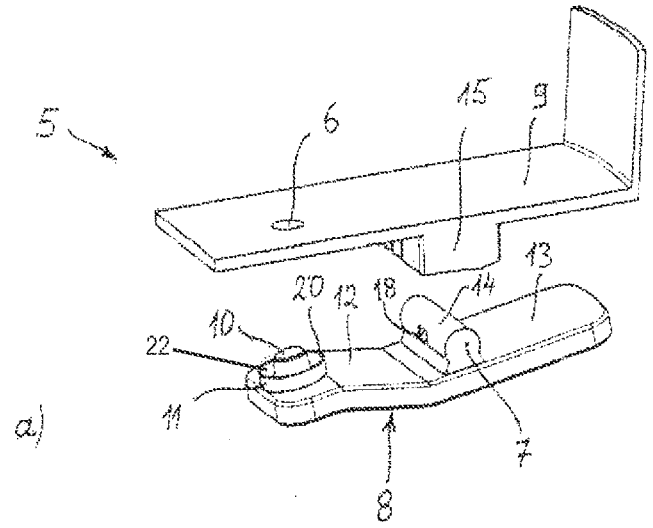
FIG. 3, perspective detail views of the valve of the fluid reservoir of FIG. 1, in exploded representations viewed obliquely from above (FIG. 3*a*) or obliquely from below (FIG. 3*b*).
Figure 3:
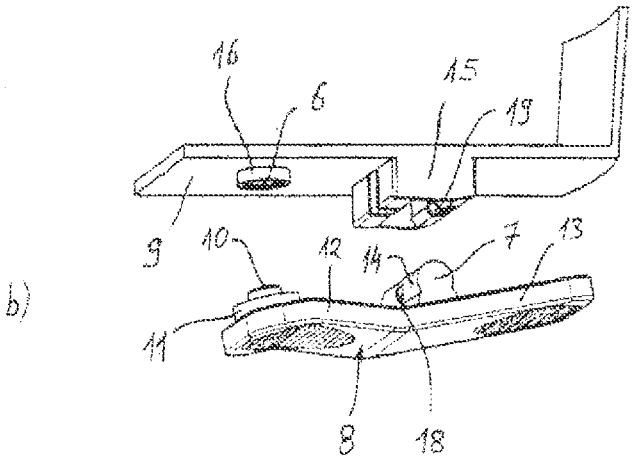

As can be seen from FIGS. 2 and 3, the valve 5 comprises a closing element 8, which can pivot about a pivot axis 7 like a rocker. The closing element 8 can pivot between a first valve position in which the closing element 8 closes the ventilation opening 6 (as shown in FIG. 2*a*), and a second valve position in which pressure equalization is allowed between the interior of the container 1 and the surroundings (as shown in FIG. 2*b*). In the first valve position, in which the closing element 8 closes the ventilation opening 6, the closing element 8 is preferably fixed in the ventilation opening 6 by means of a manually releasable gripping or latching mechanism.

The closing element 8 is composed of a first arm 12 and a second arm 13 and a pivot bearing 14 formed integrally on the bottom side of the closing element 8. The pivot bearing 14 has an essentially cylindrical shape and is clipped into a receiver bearing 15 integrally formed on the base 4 of the container 1. The receiving bearing 15 is shaped so that the pivot bearing 14 can be detachably clipped or latched in the bearing. Alternatively, the closing element 8 can also be non-detachably attached, and thus captive, so that it can pivot on the receiver bearing 15 by means of the pivot bearing 14.

A plug 10 with a cylindrical form or tapering conically forward and arranged integrally on a plug plate 11 is constructed on the top side of the first arm 12 of the closing element 8. In the closed valve position (FIG. 2*a*) the plug 10 engages in the ventilation opening 6 and closes this in a fluid-tight way. Here, the plug plate 11, which is greater in diameter relative to the plug 10, rests on the outside wall 9 of container 1 in which the ventilation opening 6 is formed. A circular groove 22 is formed in the plug plate 11, which preferably has a cylindrical construction just like the plug 10. In the closed valve position (FIG. 2*a*), a ring 16 formed around the ventilation opening 6 on the bottom side of the wall 9 and projecting from the wall 9 engages tightly in this groove 22. Through this gripping arrangement of the ring 16 in the groove 22 on the plug plate 11, a releasable fixing of the closing element 8 in the closed valve position and simultaneously a liquid-tight engagement of the plug 10 in the ventilation opening 6 is guaranteed. Preferably, the diameter of the plug 10 is matched to the diameter of the preferably circular ventilation opening 6, so that the plug 10 engages tightly in the ventilation opening 6, so that in this way a releasable fixing of the closing element 8 in the ventilation opening 6 for a closed valve position is also enabled. For this purpose, the diameter of the plug 10 is preferably tapered conically in the front.

In an alternative embodiment, the groove 22 is wider in the plug plate 11 than the width of the ring 16. A gripping effect is then realized when the closing element 8 is brought into the closed valve position. In this embodiment, the groove 22 in the plug plate 11 is used for retaining fluid that during the spraying process, has possibly settled in the region around the ventilation opening 6 and especially on the ring 16. In this embodiment, a peripheral surrounding collar 20, which surrounds the ring 16 in the closed valve position (FIG. 2*a*), is formed on the plug plate 11. The collar 20 acts as spatter protection when the ventilation opening 6 is closed by the closing element 8 and prevents the spattering of fluid or paint residue that has settled around the ventilation opening 6, and especially in the region of the ring 16, during the spraying process.

The valve 5 can be brought manually into the open valve position (FIG. 2*b*) from the closed valve position (FIG. 2*a*) through pressure on the second arm 13. With manual pressure on the second arm 13 of the closing element 8, the pivot bearing 14 pivots in the receiver bearing 15 by an angle of ca. 10 to 45°. To prevent excessive pivoting of the closing element 8, a stop is provided that in the embodiment shown in the figures is formed by an inclined surface 17 on the bottom side of the receiver bearing 15. The closing element 8 can be pivoted only so far by pressure on the second arm 13 until the top side of the second arm 13 contacts the inclined surface 17, as shown in FIG. 2*b*. For closing the ventilation opening, the closing element 8 can be brought into the closing position (FIG. 2*a*) through manual pressure on the first arm 12.

To be able to fix the closing element 8 both in the closed and also in the open valve position, catch elements 18, 19 corresponding to each other are preferably arranged on the pivot bearing 14 and on the receiver bearing 15. In the embodiment that can be taken from the drawings of FIGS. 3*a* and 3*b*, the catch elements 18, 19 are constructed in the form of recesses 18 in the pivot bearing 14 and catch tabs 19 corresponding to the recesses 18 on the receiver bearing 15. To be able to lock the closing element 8 both in the closed valve position and also in the open valve position on the receiver bearing 19, there are two recesses 18 in the pivot bearing 14 that lie on the outside of the semi-cylindrical pivot bearing 14 at opposing positions, and two corresponding catch tabs 19 on the receiver bearing 15.

In a preferred embodiment not shown here, a sealing ring is provided, which can be arranged either on the plug 10 or on the plug plate 11 or also in the ring 16, to guarantee the best possible fluid-tight closing of the ventilation opening 6.

The invention claimed is:

1. A fluid reservoir for a paint spray gun comprising:

a cup-shaped container, the cup-shaped container comprising:

a substantially open end;

a substantially closed end opposite the open end, the substantially closed end defining a base of the container;

a sidewall joining the open and closed ends;

a cover sized and dimensioned to releaseably close the substantially open end;

a ventilation opening in the base or in the sidewall, the ventilation opening encircled by a ring formed by projections of the base or of the sidewall; and a valve assembly positioned on the closed end and cooperative with the ventilation opening to releaseably close the ventilation opening, the valve assembly comprising:

a bearing block having a cylindrical recess forming a receiver bearing; and a rocking arm, the rocking arm comprising:

a pivot bearing having a cylindrical portion and an extension portion, the extension portion integrally formed with or attached to the rocking arm, having a length that extends from a first end of the cylindrical portion to a second end of the cylindrical portion, and a trapezoidal cross section, wherein the cylindrical portion of the pivot bearing is pivot-mounted to the receiver bearing for pivoting the rocking arm between a closed position and an open position, wherein the ventilation opening is open in the open position and closed in the closed position;

a first arm portion having a valve plug sized and dimensioned for releaseably closing the ventilation opening arranged on a plug plate, the plug plate having a cylindrical or a frustoconical form and a diameter greater than a diameter of the valve plug; and a second arm portion opposite the first arm portion, the second arm portion pressable for releasing the valve plug from closing the ventilation opening, wherein the ring of the ventilation opening engages in a circular groove formed in the plug plate when the rocking arm is in the closed position.

2. The fluid reservoir for a paint spray gun according to claim 1, wherein the ring of the ventilation opening is configured for blocking fluid splatter occurring when the valve assembly is pivoted to close the ventilation opening.

3. The fluid reservoir for a paint spray gun according to claim 1, wherein the circular groove formed in the plug plate has a width greater than a width of the ring encircling the ventilation opening.

4. A paint cup for a paint spray gun comprising:

a cup-shaped container, the container comprising:

a substantially open end having a threaded connector portion around a periphery thereof, the substantially open end defining a top end of the container;

a substantially closed end opposite the open end, the substantially closed end defining a bottom end of the container;

an air vent formed through the bottom end of the container;

a ring formed around the air vent projecting from the bottom end of the container;

a sidewall joining the open and closed ends;

a cover sized and dimensioned to releaseably close the substantially open end; and a valve assembly positioned on the closed end and cooperative with the air vent to releaseably close the air vent, the valve assembly comprising:

a bearing block having a cylindrical recess forming a receiver bearing having a catch tab;

a rocking arm having a first arm portion, a second arm portion extending in a direction opposite to the first arm portion, and a pivot bearing pivot-mounted to the receiver bearing of the bearing block for pivoting the rocking arm between a first position and a second position, the pivot bearing having a cylindrical portion and an extension portion, the extension portion integrally formed with or attached to the rocking arm, having a length that extends from a first end of the cylindrical portion to a second end of the cylindrical portion, and a trapezoidal cross section, wherein the air vent is closed in the first position and open in the second position;

a plug plate formed on the first arm portion of the rocking arm; and a cylindrical or frustoconical valve plug formed on the plug plate having a smaller diameter than a diameter of the plug plate, the valve plug sized and dimensioned for releaseably closing the air vent fluid-tight;

wherein the rocking arm pivots on the cylindrical portion of the pivot bearing at a point between the first and the second arm portions, the second arm is pressable to rotate the pivot bearing in the receiver bearing from a first position in which the air vent is closed to a second position in which the air vent is open, and wherein the ring engages in a circular groove formed in the plug plate when the pivot bearing is pivoted from the second position into the first position.

5. The paint cup for a paint spray gun according to claim 4, wherein the circular groove formed in the plug plate has a width greater than a width of the ring formed around the air vent.

6. The paint cup for a paint spray gun according to claim 4, wherein the air vent and the valve assembly are positioned proximate a periphery of the closed end of the container.

7. The paint cup for a paint spray gun according to claim 4, further comprising a stop arranged for limiting movement of the pivot bearing substantially beyond the second position.

8. The paint cup for a paint spray gun according to claim 7, wherein the stop is an inclined surface on the bearing block.

9. The paint cup for a paint spray gun according to claim 4, wherein the cylindrical portion of the pivot bearing is mateably and pivotably-connectable to the cylindrical recess of the bearing block.

10. The paint cup for a paint spray gun according to claim 4, wherein the first and the second arm portions of the rocking arm extend to each side of the pivot bearing.

11. A paint container for a paint spray gun comprising:

a substantially open end having a connector portion around a periphery thereof;

a substantially closed end opposite the open end;

an air vent formed through the closed end;

a ring surrounding the air vent projecting from the closed end;

a cylindrical sidewall joining the open and closed ends;

a rim surrounding and extending beyond the closed end in a direction away from the open end; the rim configured to support the paint container in a filling and storage position in which the open end is positioned topmost with respect to the closed end;

a cover sized and dimensioned to releaseably close the substantially open end, the cover including:

a. a connector portion mateable with the connector of the open end to form a liquid tight seal, and b. a dispensing port having a connector portion for affixing the cover and attached container onto the paint spray gun;

a valve assembly positioned on the closed end and cooperative with the air vent to releaseably close the air vent, the valve assembly including:

a. a bearing block integrally formed from material of the closed end, the bearing block having a cylindrical recess forming a receiver bearing, a first catch element, and a second catch element; and b. a rocking arm pivotally connected to the bearing block, the rocking arm including:

i. a first arm portion having a valve plug dimensioned for releaseably closing the air vent arranged on a plug plate, the plug plate having a cylindrical or a frustoconical form, a circular groove formed therein, and a diameter greater than a diameter of the valve plug;

ii. a second arm portion extending opposite the first arm portion, the second arm portion pressable for releasing the valve plug from closing the air vent; and iii. a pivot bearing having a cylindrical portion and an extension portion, the extension portion integrally formed with or attached to the rocking arm, having a length that extends from a first end of the cylindrical portion to a second end of the cylindrical portion, and a trapezoidal cross section, wherein the cylindrical portion of the pivot bearing is pivot-mounted to the receiver bearing of the bearing block for pivoting between a first position in which the air vent is closed and a second position in which the air vent is open;

wherein the ring surrounding the air vent engages the circular groove in the plug plate when the pivot bearing is in the first position.

12. The paint container for a paint spray gun according to claim 11, wherein the pivot bearing comprises:

a third catch element mateable with the first catch element of the bearing block, the mating first and third catch elements configured to releaseably maintain the valve assembly in the first position when the air vent is closed; and a fourth catch element mateable with the second catch element of the bearing block; the mating second and fourth catch elements configured to releaseably maintain the valve assembly in the second position when the air vent is open, whereby the valve assembly is prevented from moving from the first position to the second position when the first and third catch elements are mated and the valve assembly is prevented from moving from the second position to the first position when the second and fourth catch elements are mated.

13. The paint cup for a paint spray gun according to claim 11, wherein the circular groove formed in the plug plate has a width greater than a width of the ring surrounding the air vent.

14. The paint container for a paint spray gun according to claim 11, wherein the valve plug has a conical, tapered form sized and dimensioned for inserting into and sealing the air vent.

15. The paint container for a paint spray gun according to claim 11, wherein the pivot bearing of the rocking arm is snap connected to the receiver bearing of the bearing block.

16. The paint container for a paint spray gun according to claim 12, wherein the third and fourth catch elements are formed as recesses in the pivot bearing.

* * * * *